United States Patent [19]

Prazak,III et al.

[11] 3,993,516

[45] Nov. 23, 1976

[54] METHOD OF CONTROLLED ETCHING IN THE MANUFACTURE OF A COLOR SELECTION MASK FOR A COLOR CATHODE RAY TUBE

[75] Inventors: Charles J. Prazak,III, Elmhurst; Raymond M. Stachniak, Chicago, both of Ill.

[73] Assignee: Zenith Radio Corporation, Chicago, Ill.

[22] Filed: Oct. 7, 1974

[21] Appl. No.: 512,583

[52] U.S. Cl. ..... 156/3; 96/36.1; 156/6; 156/11; 156/18

[51] Int. Cl.[2] ..... H01J 9/20

[58] Field of Search ..... 156/8, 11, 18, 3, 6; 96/36, 36.1

[56] References Cited

UNITED STATES PATENTS

| | | | |
|---|---|---|---|
| 3,423,261 | 1/1969 | Frantzen | 96/36.1 |
| 3,661,581 | 5/1972 | Feldstein | 96/36.1 |
| 3,725,065 | 4/1973 | Fadner | 96/36.1 |
| 3,730,719 | 5/1973 | Law | 96/36.1 |
| 3,788,846 | 1/1974 | Mayaud et al. | 96/36.1 |

*Primary Examiner*—William A. Powell
*Assistant Examiner*—Jerome W. Massie
*Attorney, Agent, or Firm*—John H. Coult

[57] ABSTRACT

A method of forming a pattern of electron-transmissive apertures in a color selection mask for a color cathode ray tube. The method includes providing an electrically conductive preformed blank comprising a relatively thin aperture-defining layer on a relatively thick substrate layer; establishing a first etchant-resistant structure on the aperture-defining layer; etching through the blank to form preliminary sized and shaped apertures in the aperture-defining layer; establishing a second etchant-resistant structure on the aperture-defining layer; etching the aperture-defining layer forming ultimate apertures in the aperture-defining layer; and stripping the etchant-resistant structure from the aperture-defining layer.

28 Claims, 49 Drawing Figures

APPLY PHOTO RESIST AND DRY.

EXPOSE PHOTO RESIST THROUGH FIRST MASTER

DEVELOP PHOTO RESIST

ETCH THROUGH BLANK

EXPOSE PHOTO RESIST LAYER AGAIN

EXPOSED RIM OF PHOTORESIST AROUND PRELIMINARY APERTURES

DEVELOP RIM OF PHOTO RESIST

ETCH APERATURE DEFINING LAYER

STRIP PHOTORESIST COATING

COAT PREFORMED LAMINATED BLANK WITH NEGATIVE PHOTORESIST

EXPOSE NEGATIVE PHOTORESIST

DEVELOP NEGATIVE PHOTORESIST

ETCH THROUGH BLANK

STRIP FIRST NEGATIVE PHOTORESIST COATING

APPLY SECOND COATING OF NEGATIVE PHOTORESIST

EXPOSE SECOND COATING OF NEGATIVE PHOTORESIST

DEVELOP SECOND COATING OF PHOTORESIST

ETCH THE BLANK AND STRIP THE PHOTORESIST

DOUBLE MASTER

EXPOSE PHOTORESIST THROUGH DOUBLE MASTER

PROVIDE MASK BLANK

METAL FORM MASK BLANK

COAT WITH POSITIVE PHOTORESIST AND EXPOSE

DEVELOP PHOTORESIST AND ETCH BLANK

PHOTO SCREEN GRAPHITE GRILL USING MASK AS STENCIL

EXPOSE PHOTORESIST THROUGH SECOND MASK

DEVELOP EXPOSED PHOTORESIST

TO ENLARGE APERTURE, ETCH AND STRIP PHOTORESIST

FIG-37.

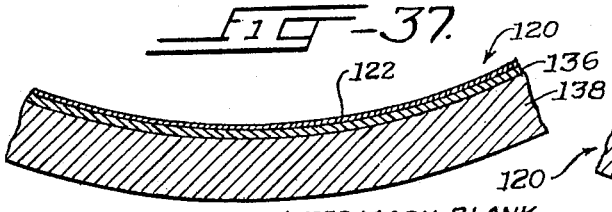

OAT PREFORMED LAMINATED MASK BLANK
NITH NEGATIVE PHOTORESIST

FIG-38.

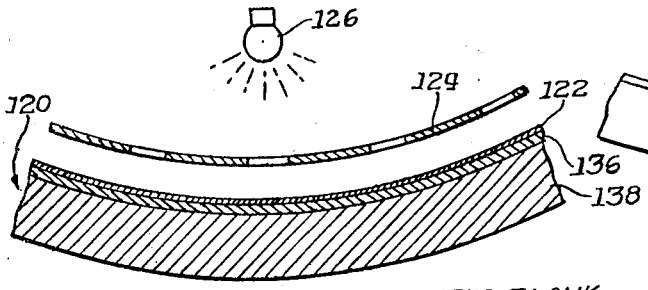

EXPOSE NEGATIVE RESIST COATED BLANK
THROUGH NEGATIVE MASTER

FIG-39.

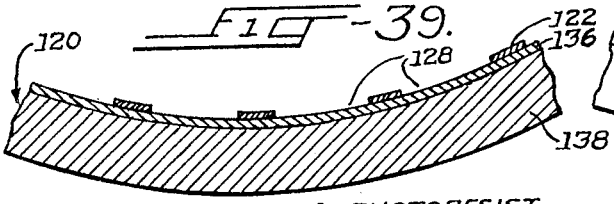

DEVELOP EXPOSED PHOTORESIST
COATED BLANK

FIG-40.

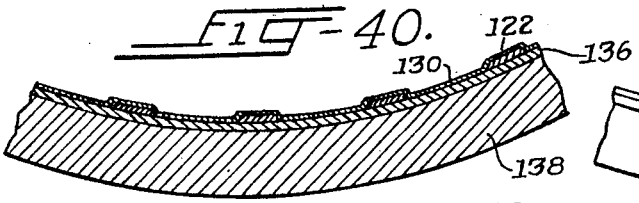

COAT NEGATIVE PHOTORESIST COATED
BLANK WITH POSITIVE PHOTORESIST

FIG-41.

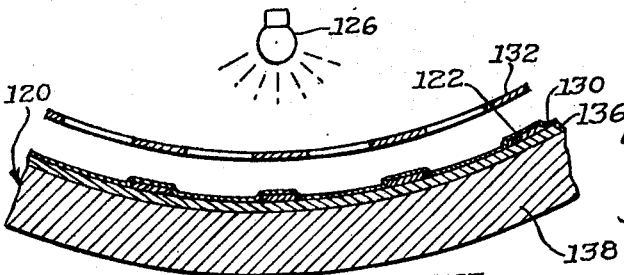

EXPOSE POSITIVE PHOTORESIST
THROUGH POSITIVE MASTER

FIG-42.

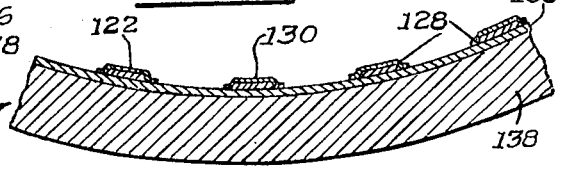

DEVELOP POSITIVE PHOTORESIST

FIG-43.

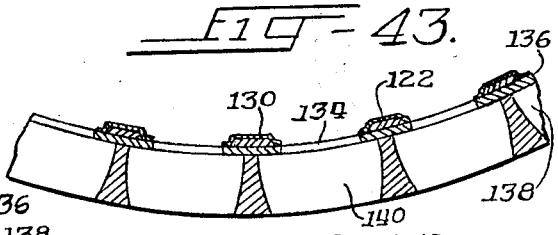

ETCH APERTURE AND
SUBSTRATE LAYERS

FIG-44.

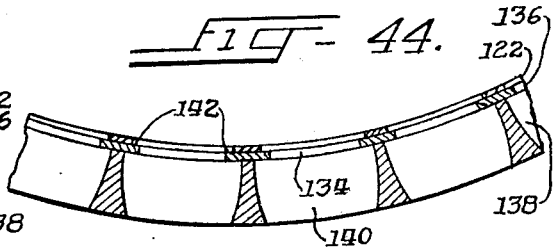

STRIP POSITIVE PHOTORESIST

FIG-45.

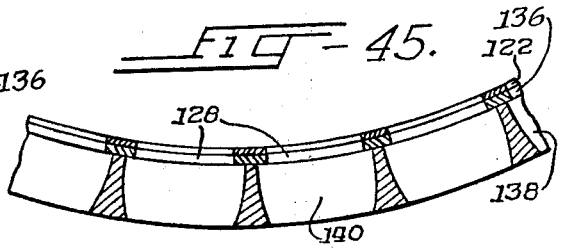

ETCH APERTURE LAYER

FIG-46.

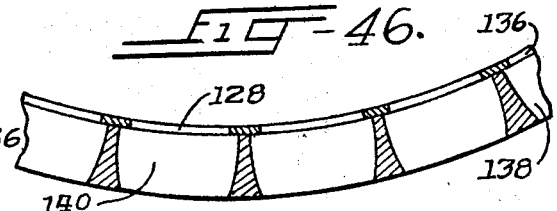

STRIP NEGATIVE PHOTORESIST

METHOD OF CONTROLLED ETCHING IN THE MANUFACTURE OF A COLOR SELECTION MASK FOR A COLOR CATHODE RAY TUBE

CROSS REFERENCE TO RELATED APPLICATIONS

This application relates to, but is in no way dependent upon, copending applications Ser. No. 466,102, filed May 2, 1974 in the name of R. Stachniak and Ser. No. 471,420, filed May 30, 1974 in the name of K. Palac, both having a common assignee herewith. This application further relates to, but is in no way dependent upon, copending applications Ser. No. 520,836, filed Nov. 4, 1974 and Ser. No. 538,846, filed Jan. 6, 1975, both having a common assignee herewith.

BACKGROUND OF THE INVENTION

This invention relates generally to cathode ray tubes for color television and specifically to construction of improved color selection masks therefor.

Every commercial color television cathode ray tube today includes a color selection mask which allows a selected pattern of electrons to impinge upon a corresponding pattern of light-emitting phosphor elements deposited on a cathode ray tube panel. A typical color selection mask is of the shadow mask variety, comprising a thin sheet of steel having a pattern of electron-transmissive apertures etched therein. The apertures take various forms, although typically take the form of small round holes or vertical rows of aligned slots.

Naturally, it has been desirable to etch the mask apertures as accurately as possible in order to provide each mask with accurately positioned apertures having a predetermined size and shape.

The most straight-forward method of forming the mask apertures would be to coat one side of the mask blank with an etchant-resistant coating in which there is a pattern of holes through which an etchant may be applied to the blank. The blank would then be etched by spraying an etchant onto the portion of the blank surface not protected by the etchant-resistant coating. This spray would be continued until the etchant mills a hole through the blank. Since this method of forming mask apertures would include etching from only one side of the blank, it is referred to herein as one-sided etching. FIG. 1 is a portion of a color selection mask as it would appear if etched by such a one-sided etching process.

It has been found that it is difficult to control the size of the holes which are formed in a blank with one-sided etching. For example, variations in the thickness of a blank, which is normally made of 6 mil steel, etching non-uniformities and hole cleanliness tend to introduce undesirable variations in the size and shape of the mask apertures. A particularly undesirable characteristic of one-sided etching is that, while the etchant is creating an opening in the steel in the direction of the thickness of the blank, it is also laterally etching away or "undercutting" the metal of the blank beneath the etchant-resistant coating which lies on the surface of the blank. This undercutting continues as long as the etchant is applied to the blank and is definitely undesirable from the standpoint of mask strength. The thicker the blank, the longer the etchant must be applied to completely etch through the blank, thus a greater amount of undercutting is caused to occur during the process. Typically, an etchant will undercut or etch laterally about 0.5 mils for every 1 mil of through etching. Thus, for a 6 mil thick blank, undercutting may eat away up to 3 mils or more of the blank around each aperture.

In order to avoid the undesirably large amount of undercutting which is associated with one-sided etching, methods of etching masks from two sides have been developed and are used commercially throughout the world. Conventional methods of manufacturing color selection masks start with a flat blank sheet of metal nominally 6 mils thick. Normally the first step in the etching process is to coat at least one surface of the blank with a photoresistant material. In the two-sided manufacturing process both sides of the blank are coated with the photoresistant material.

Photoresist materials are of either the positive-working or negative-working type and are referred to as either positive or negative photoresists. A positive photoresist, on exposure to actinic light, undergoes changes which render it soluble in a developing solution which may be used to wash away the exposed photoresist. A negative photoresist, on exposure to actinic light, undergoes polymerization and becomes insoluble in an associated developing solution.

Although either type of photoresist may be used, for purposes of simplicity and clarity of description, the following background discussion deals exclusively with the use of a positive photoresist.

In the two-sided etching process, corresponding mask masters having predetermined related patterns of light-transmissive areas and the photoresist-coated blank are placed on a conventional lighthouse where an illumination pattern of electron-transmissive apertures is formed on each blank surface by exposing the photoresist coatings to actinic light transmitted through each respective mask master. The exposed areas, corresponding to the pattern of apertures, are solubilized and are washed away in a developing solution, baring the metal electrode surfaces.

An etchant is sprayed from a battery of etchant nozzles onto the opposed blank surfaces, etching those areas of the blank bared by the exposure and development processes. The etchant mills through the blank from both sides to form the desired electron-transmissive apertures in the blank, as shown in FIG. 2.

In addition to the through etching of the blank, it has been found that lateral etching or undercutting of the photoresist layer also occurs at a rate of approximately one-half the rate of the through etching; thus in a typical blank 6 mils thick the lateral etching would normally be approximately 3 mils, or 1½ mil around the aperture periphery. However, since in the two-sided process the etchant etches through the blank from each side, the lateral etching is correspondingly reduced. Yet, because of this lateral etching, even though substantially reduced by the two-sided process, it is extremely difficult to control the shape of the aperture periphery. It has been found, in the manufacture of slot-type masks, to be very difficult to form tie bars which are acceptably narrow without unduly weakening the mask.

As said before, customarily aperture etching is performed on a flat sheet of electrically conductive metal. After the desired apertures have been etched, the etched mask is spherically or biradially formed to approximately the same contour as the cathode ray tube faceplate to which it is to be mated. During the forming process varying degrees of stress are put on the blank, causing many of the apertures, especially those on the mask edges, to be deformed. The forming process consists primarily of a stamping or drawing operation which by its nature causes different stresses to be put on individual masks and mask sections. Similarly, the positioning devices for holding the mask on the forming device do not position each individual mask in the same location, thus each resulting formed mask is different from all others, causing non-uniformity in the array of apertures from mask to mask.

These stresses and the non-uniformity of the aperture array from mask to mask virtually rule out the possibility of making color selection masks that are interchangeable each with all others in the assembly of a cathode ray tube of a given size and shape. The present state of the art compensates for the deformation variations from mask to mask by uniquely mating a given mask to a given cathode ray tube faceplate. Each mask is used as the stencil or master during the photoprinting of the phospher screen on the cathode ray tube faceplate. Thus, any irregularities in the mask are duplicated in the screen patterns formed on the faceplate. Clearly, since each mask has different aperture deformations and a non-uniform array of apertures, random interchangeability of masks and faceplates is not possible with conventional tube manufacturing methods.

It is desirable in the interest of standardizing mask aperture patterns, to preform the mask blank prior to the etching process. Etching a preformed blank would virtually eliminate aperture deformation caused by the forming process. Substantial aperture pattern uniformity from mask to mask would enable the faceplate phosphor pattern to be made with a single mask master.

The primary disadvantage of the two-sided etching approach described above is the strict requirement of hole pattern alignment needed on opposite sides of the blank to precisely form properly sized and shaped apertures. The disadvantage has the practical effect of possibly limiting the applicability of the two-sided process to flat blanks. Thus, to manufacture masks from preformed blanks enabling random interchangeability of masks and cathode ray tube faceplates, it appears that some type of one-sided etching process, avoiding the requirement of registering masters on opposite sides of a pre-contoured blank, is the practical solution.

One approach to one-sided etching of the photoresist, described and claimed in U.S. Pat. No. 3,794,873, and having a common assignee herewith, utilizes a laminated color selection mask as shown in FIG. 3 wherein typical laminants comprise a thin nickel aperture-defining layer bonded to a relatively thick substrate layer of steel. Two etchants are used — one to etch through the aperture-defining layer, hereafter referred to as an aperture layer etchant, and the other to etch through the steel substrate layer, hereafter referred to as a substrate etchant. It has been found that the severe undercutting of the aperture-defining layer which results from one-sided etching is somewhat reduced by this method. The substrate reacts quickly to the substrate etchant and slowly to the aperture layer etchant and the aperture-defining layer reacts similarly to the respective aperture etchant and substrate etchant. The respective reaction times reduce the overall etching time for etching through the blank, thereby reducing the time the etchant is in contact with the respective layers and resulting in reduced undercutting in the substrate. However, a serious problem still exists in the manufacture of slot-type masks where narrow tie bars (e.g., 4 mils or less) must be formed.

The severe undercutting associated with one-sided etching has led to alternative methods of one-sided etching for color selection masks. In one method, described and claimed in the referent application Ser. No. 466,102, to avoid this severe undercutting and the registration problems associated with the two-sided etching process, a laminated color selection mask blank is coated on one side with an etchant-resistant coating. A typical laminate mask blank may comprise a ½ mil aperture-defining layer of nickel, a 1½ mil core layer of copper alloy, and a 4 mil steel substrate, as shown in FIG. 4. After the etchant-resistant coating is applied, an aperture array is made by exposing the photoresist coating, through a master, to actinic light and developing the exposed areas. An etchant, which may be ferric chloride, is then applied to the blank. The first etchant chemically etches the aperture-defining layer and the core layer. After a wash process, a second etchant, typically ferric sulfate, is applied to the partially etched mask blank. The nickel aperture-defining layer and the copper core layer, being impervious to ferric sulfate, resist etching while the steel substrate is being etched. Reduced undercutting results. This process of etching has formerly been labeled a laminated coring one-sided etching process.

Another method of performing one-sided etching without producing severe undercutting, described and claimed in the referent application Ser. No. 471,420, uses a laminate mask blank which may be composed of a ½ mil nickel aperture-defining layer bonded to a 6 mil substrate of steel. See FIG. 3 for basic construction of a blank used in this method. The color selection mask blank is first coated with a photoresist and etched with an etchant, typically ferric chloride. After the first etching process the blank, including the cavities etched by the first etchant, is again coated with a photoresist material (preferably of the positive-working type) and the cavity bottoms only are subsequently exposed to ultraviolet light. Upon development of the photoresist, the unexposed photoresist is retained on the surface of the mask blank and the undercut portions of the cavity, leaving exposed only that portion of the cavity exposed (on the second exposure) to the ultraviolet irradiation. Upon application of a second etchant such as ferric sulfate, the substrate is etched through. The resulting mask aperture profile is not shown, but is similar to that shown in FIG. 4. The same method may be used on a single layered blank, as shown in FIG. 5, a method where the etching is from the convex side of the preformed blank.

Each of the prior art methods of one-sided etching represent improvements in the basic one-sided aperture etching process, but have been found not to be completely satisfactory in every respect. The myriad of problems associated with one-sided etching, the most severe being the undercutting problem, has before this invention made one-sided etching a difficult approach to etching acceptable apertures of the slot type in a preformed mask blank. In a slot-type mask, the vertically running slats separating the openings or slots in the mask through which the electrons pass on their way to the cathode ray tube screen are held together by horizontally running tie bars which, for the sake of maximized brightness and minimum moire' pattern generation, should be as narrow as possible. The one-sided etching processes known to date are not completely acceptable because of the weakened condition of the mask which results from the undercutting or etching away of the tie bar areas. To compensate for the described undercutting, and to impart sufficient strength to the mask, the tie bars have had to be made undesirably wide. This invention provides a method of etching preformed blanks maintaining narrow, structurally strong tie bars and having reduced undercutting of the aperture-defining layer.

The above discussion has dealt primarily with the problems associated with etching or shadow masks from one side and certain prior art attempts to cope with such problems, particularly in the context of shadow masks which are preformed (precontoured) before being etched (from one side). This invention has broader applicability, however.

In tubes of the negative guardband, black surround type, as explained, the electron beam landing spots are larger than the impinged phosphor elements. Since in conventional practice the shadow mask is used as the exposure stencil during the photoexposure operations used to screen the faceplate, some method must be provided for causing the electron beam spots to be larger than the impinged phosphor elements. Two methods are employed commercially. The first is the so-called "re-etch" or "etch-back" method wherein the shadow mask apertures are originally formed to the (smaller) size of the phosphor elements, and then after the screening operations, the shadow mask is "re-etched" (etched a second time) until the shadow mask apertures are larger than the phosphor elements by an allotted tolerance value, thus producing the desired negative guardband.

The second method used commercially to cause the mask apertures to be larger than the associated phosphor elements is to use a shadow mask which has full-sized apertures and, by the use, e.g., of special photoreduction techniques during the screening operation, to cause the phosphor elements to be smaller than the shadow mask apertures.

By the application of this invention, there may be provided yet another commercially practicable method for making shadow mask-faceplate assemblies in which the mask apertures are ultimately larger than the associated phosphor elements.

OBJECTS OF THE INVENTION

It is a primary object of this invention to provide an improved method of etching electron-transmissive apertures in a color cathode ray tube color selection mask.

It is another object of this invention to provide a method for etching apertures in a color cathode ray tube mask from one side, which method offers greatly improved control of the size, shape and distribution of the apertures, and greatly reduced undesirable aperture undercutting.

It is yet another object of this invention to provide an improved process for etching slots in a slot-type cathode ray tube color selection mask, which method results in a reduced amount of undesirable undercutting of the tie bars, thus yielding narrow but strong tie bars.

It is still another object of the invention to provide an improved method of etching such slot apertures which results in precision etching of the tie bars.

It is still another object to provide a method by which apertures in a color selection mask for a color cathode ray tube can be formed with precision.

It is also an object of this invention to provide an improved method of etching apertures in a color cathode ray tube selection mask which is intended to be interchangeable between cathode ray tubes of a given size and shape.

It is yet another object to provide an improved method for making a color cathode ray tube of the negative guardband, black surround type, and particularly an improved method for making a shadow mask having relatively small apertures useful for screening a phosphor pattern on a cathode ray tube faceplate and for enlarging the apertures, after screening, to the desired ultimate size.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIGS. 37–46 collectively show a method of utilizing the inventive process.

DESCRIPTION OF THE PREFERRED EMBODIMENTS

Figure 1:
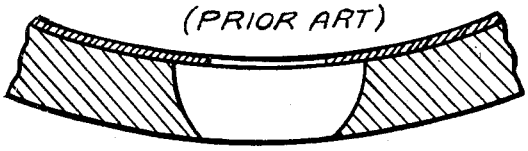
FIG. 1. (PRIOR ART)
FIGS. 1–5 are cross-sectional views of apertures etched in mask blanks by prior art processes.
Figure 2:
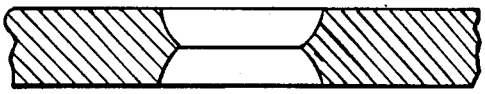
FIG. 2. (PRIOR ART)
Figure 4:
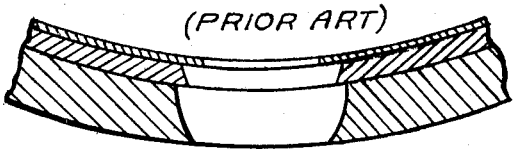
FIG. 4. (PRIOR ART)
Figure 3:
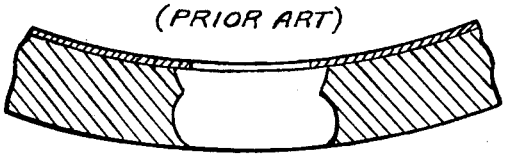
FIG. 3. (PRIOR ART)
Figure 5:
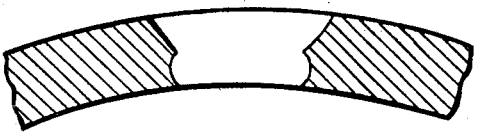
FIG. 5. (PRIOR ART)
Figure 6:
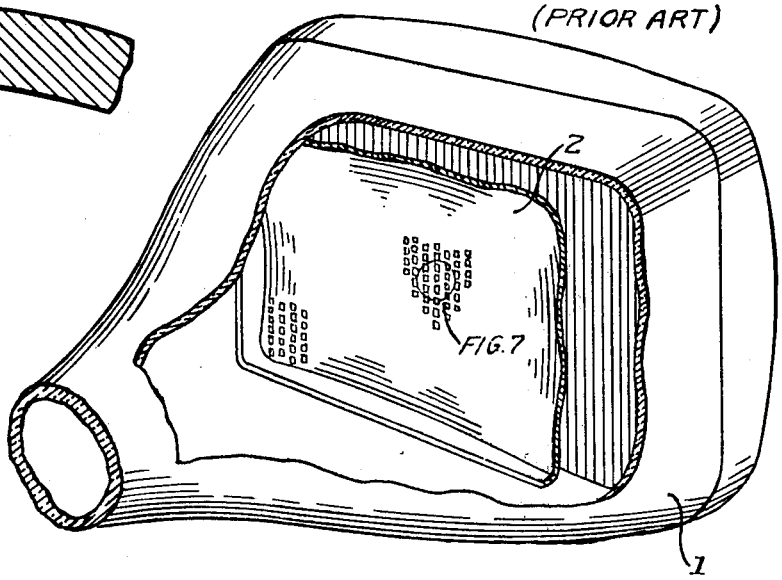
FIG. 6. (PRIOR ART)
FIG. 6 is a diagrammatic view of a cathode ray tube utilizing a typical slot-type shadow mask.

FIG. 6 schematically depicts a portion of a color television cathode ray tube 1 having a color selection mask 2 of a type generally referred to as a slot mask. Portions of FIG. 6 have been shown with exaggerated dimensions to more clearly show the interrelationship between the color selection mask, the slots 4 on that mask and the other portions of the cathode ray tube.

Figure 7:
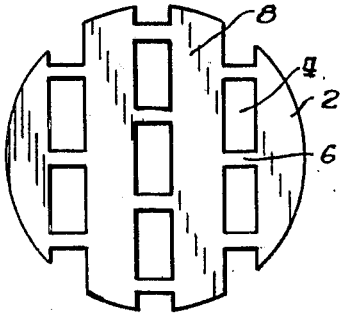
FIG. 7. (PRIOR ART)
FIG. 7 is an enlarged view of a portion of the slot-type shadow mask in FIG. 6.
Figure 8:
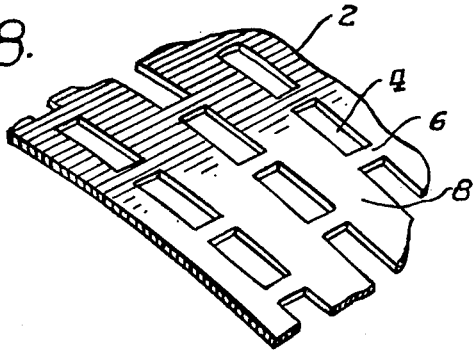
FIG. 8 is a portion of the slot-type shadow mask shown in FIG. 6, showing the three-dimensional curvature characteristics of the mask.

FIG. 7 is an enlarged view of the portion of the slot mask 2 shown in FIG. 6. The mask 2 comprises a sheet of electrically conductive material such as steel having formed therein apertures or slots 4, separated vertically by narrow sections of the mask, commonly referred to as tie bars 6, and vertically running slats 8 between the vertical rows of slots 4. The mask 2 generally takes a spherical, bi-radial or other three-dimensional contour much like that portion of the color selection mask displayed in FIG. 8. As previously mentioned, the most common problem in the formation of apertures in the slot-type mask manufacturing process is the maintenance of structurally strong but narrow tie bars between the slots. Again, the tie bars 6 should be narrow enough to suppress moire-type patterns on the cathode ray tube screen and reduce electron beam aborption, but strong enough to give structural support to the mask. Most conventional etching processes inadequately control the size, shape and profile of the slots, and consequently the resulting tie bars between the slots.

FIGS. 9A through 17 represent schematically the steps of one method according to the present invention. Manufacturing color selection masks for color television cathode ray tubes in accordance with the invention commences with the provision of an etchable, electrically conductive flat blank 24 of metal. See FIG. 9A. The preferred embodiment utilizes an electrically conductive laminated flat blank 24 comprising a substrate layer 16, hereinafter called the substrate 16, and an aperture-defining layer 18. In the preferred embodiment the substrate 16 comprises an approximately 6 mil thick layer of steel and the aperture-defining layer 18, hereinafter called the aperture layer, comprises a nominal ½ mil thick layer of nickel. The two layers are either bonded together, or the nickel is plated on the steel substrate layer, to form the electrically conductive blank 24.

Figure 9A:
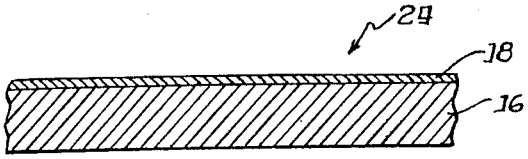
FIGS. 9A–17 collectively show one process embodied in the present invention.
Figure 9B:
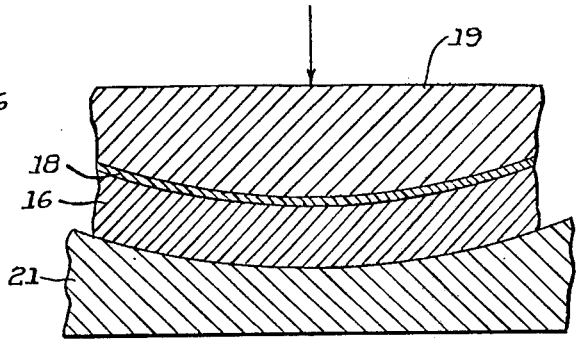

Prior to etching the blank 24, it is desirable to preform it to a generally three-dimensional shape such as a bi-radial generally spherical shape. A general concept of the forming process is shown in FIG. 9B. The blank may be formed by a stamping process wherein the aperture layer 18 is on the concave side of the blank 24 after the forming process and the substrate 16 is on the convex side of the blank after the forming process. Any type of stamping or drawing process may be used which will adequately preform the blank into a generally spherical, bi-radial, or other desired contour. As conceptually shown in FIG. 9B, a movable force F is applied to the aperture layer side of the blank 24, forcing the blank 24 as a whole to take the form of both the force applying member 19 and a stationary member 21.

After preforming electrode blank 24 into a three-dimensionally curved shape, a first patterned, etchant-resistant structure is established on the concave aperture layer, forming a pattern of openings on the aperture layer. This pattern corresponds to the pattern of electron-transmissive apertures subsequently to be formed in the aperture layer, but at least a predetermined group of the openings are of a smaller size than the ultimate mask aperture size. The preferred approach to establishing this etchant-resistant structure is to coat the mask blank, preferably the aperture layer, with at least one layer of photoresist material, then use well-known photographic exposure and developing methods to form the preselected pattern of openings in the aperture layer.

Figure 10:
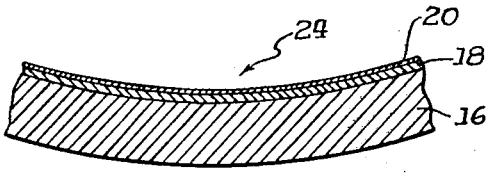

In the preferred embodiment of the invention, a coating 20 of photoresist, nominally 1–2 microns thick, is applied, FIG. 10, to the surface of the aperture layer 18. For example, a type of photoresist which may be used is Shipley's AZ 1350. As explained in the Background of the Invention, there are two types of photoresist material that may be used in the etching process. The preferred embodiment uses a positive photoresist material on the aperture layer 18 as shown in FIG. 10. When actinic light from a source 44 exposes a positive photoresist material, the exposed areas become depolymerized and thus are soluble in an appropriate developer solution. The positive photoresist coating 20 on the aperture-defining layer 18, if of the type noted, is preferably exposed for approximately 15 seconds through a positive first mask master 30 as shown in FIG. 11A.

Figure 11B:
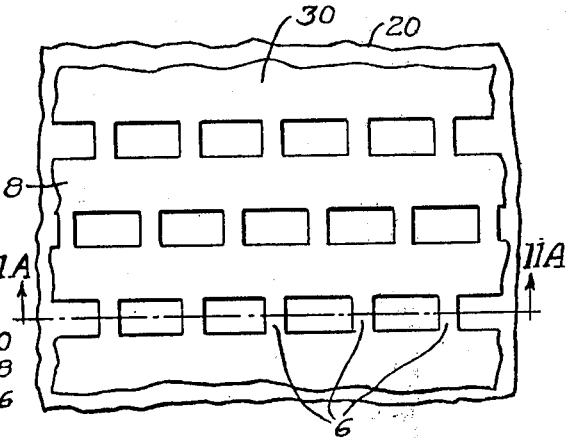
Figure 11A:
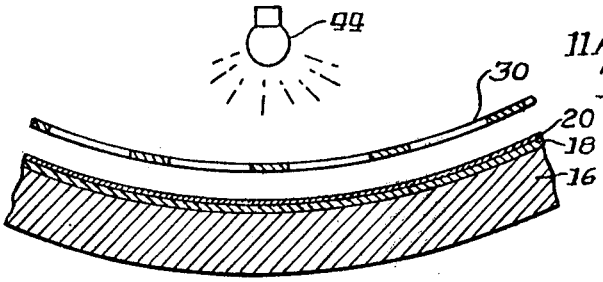

FIG. 11B shows a top view of the photoresist layer 20 as viewed through the first master 30. Those areas of the photoresist coating 20 seen through the master are the photoresist areas to be exposed by actinic light from source 44. The first master 30 has a first preselected pattern of apertures which correspond in distribution to the general pattern of electron-transmissive apertures to be formed on the electrode blank 24. At least a predetermined group, if not all, of these pattern elements are of a smaller size than the desired size of the ultimate apertures to be eventually formed in aperture layer 18. The reason for this will become clear as this description proceeds.

Figure 12:
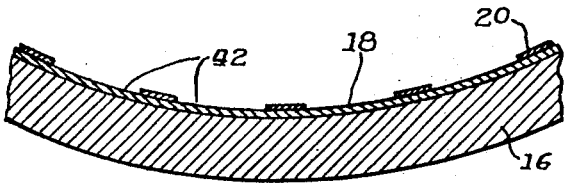
Figure 13:
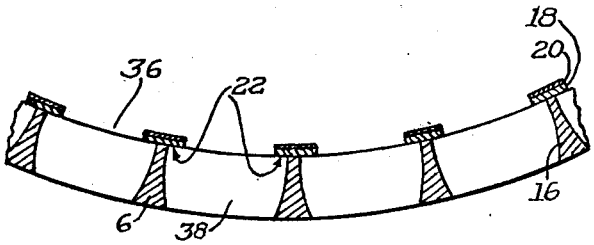

A caustic base developing solution is used to develop those photoresist areas exposed to light source 44, forming patterns of openings 42 in positive photoresist layer 20, as shown in FIG. 12, that correspond to the illumination pattern formed by master 30 and light source 44.

After the pattern of openings 42 is formed in the coating 20 by the developer solution, the blank 24 is sprayed with an etchant solution such as ferric chloride, having a concentration of 42 Baume, from a battery of etchant spraying heads. The etchant is sprayed onto the concave side of the blank at approximately 25 psi for approximately 1½ minutes. The etchant chemically attacks those bared areas of the nickel aperture layer, forming in the blank a preliminary pattern of sharply rectangularly shaped apertures 36.

In the preferred embodiment a 1½ minute spray of etchant etches through the nominal ½ mil layer of nickel and approximately 2 to 3 mils of the 6 mil substrate 16. As the etchant etches through the substrate 16, undercutting 22 of the aperture layer 18 occurs at the rate of about 2:1, i.e., for every mil of through etching, approximately 0.5 mil of lateral etching or undercutting occurs.

After the ferric chloride etchant is applied for approximately 1½ minutes, a second etchant, preferably ferric sulfate, 35–40% by weight, is sprayed from a battery of spraying heads onto the partially etched apertures to finish etching through the substrate 16 of steel. The nickel aperture-defining layer 18 used in the preferred embodiment is virtually insoluble in the ferric sulfate etchant, thus virtually no etching of the aperture-defining layer occurs during the ferric sulfate etchant application, most of the etching being through the remaining 3 to 4 mils of the steel substrate 16. The apertures 38 formed in the steel substrate have the ultimate desired size. After the preliminary apertures 36 are formed in the aperture layer 18 and the ultimate apertures 38 are formed in the substrate 16, the electrode blank is washed and dried and prepared for a second exposure.

After forming a pattern of preliminary shaped apertures 36 in the aperture layer 18 it is desirable to establish a second etchant-resistant structure on the aperture layer 18. The second structure preferably has formed therein a second preselected pattern of openings which substantially correspond in distribution to the pattern in the first structure, but at least a predetermined group of the openings being greater in size than their corresponding counterparts in the first structure.

Figure 14A:
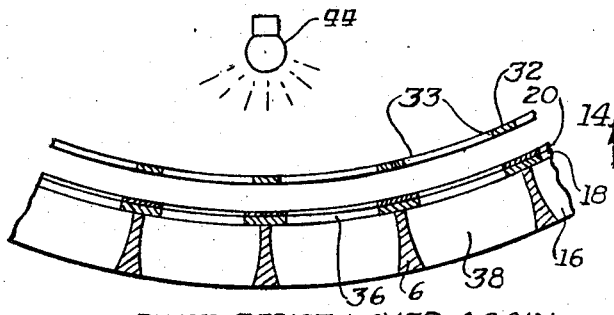
Figure 14B:
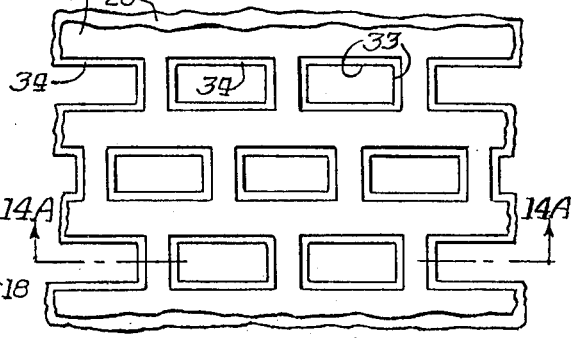

In the preferred embodiment the positive photoresist coating 20 is utilized along with a second master 32 to establish the second etchant-resistant structure. The second master 32, which has substantially the same distribution of openings as the first master 30, FIGS. 14B and 11B respectively, but which has at least a predetermined group of its openings 33 larger in size than their respective counterparts in master 30, is placed with the once-etched blank 24 on a lighthouse, preferably the same lighthouse in which the first exposure of the coating 20 was made. See FIG. 14A. Each rim 34 of the photoresist coating 20, around the preliminary etched openings 36, FIG. 14B, is exposed by light source 44 which is actinic to the photoresist coating, forming a second illumination pattern on the photoresist coating 20 in which the pattern elements substantially correspond in distribution to their respective counterparts in the illumination pattern formed by the first exposure operation. The ultimate sized and shaped apertures to be formed in aperture layer 18 are each defined by the area of the preliminary aperture 36 and the area comprising the rim 34. At least a predetermined group of the second illumination pattern elements in the aperture layer 18 have a respectively larger element size than their respective counterparts formed in the aperture-defining layer by the first master.

In the manufacture of a slot-type mask having, e.g., slots 9 mils wide and 28 mils long, with 4 mil tie bars, the photoresist rim 34 around each of the preliminary shaped apertures may be approximately 2 mils wide on each side thereof and approximately 3 mils wide on each end thereof.

Figure 15:
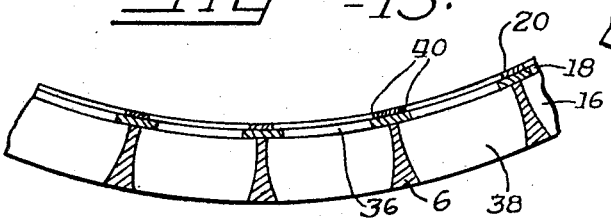
Figure 16:
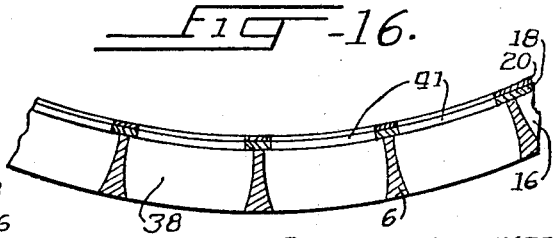

The rim 34 of exposed photoresist shown in FIG. 14B is developed by a caustic base developer which may be the same as that developer employed in the first developing process. The developing solution bares a rim 40 of the nickel aperture layer as shown in FIG. 15. This rim 40 in aperture layer 18 corresponds directly to the rim 34 of photoresist 20 shown in FIGS. 14A and 14B. The bared rim 40 in the aperture layer is etched as with a ferric chloride etchant which may have the same concentration as the ferric chloride etchant used in the first etchant operation. It is preferable to spray the etchant solution onto the blank 24 at substantially 15–25 psi for approximately 10 seconds, etching the aperture layer 18, forming therein the desired ultimately shaped, sharply rectangular apertures 41. See FIG. 16. These electron-transmissive apertures 41 in the aperture-defining layer have the desired ultimate size and shape, and have substantially the same distribution pattern as the preliminary sized and shaped apertures 36 etched in the first etching operation.

Figure 17:
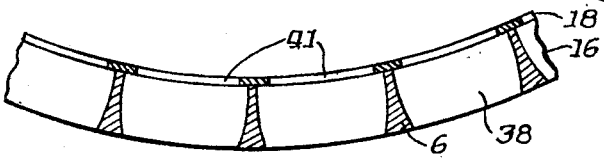

After the second etching process, the etched blank 24 is stripped of the remaining photoresist 20 (FIG. 17). The blank is then washed and dried. After drying the etched blank, the resulting electron-transmissive color selection slot mask having precisely formed, sharply rectangular apertures 41 in the aperture layer 18 is prepared for mounting in a cathode ray tube faceplate.

Virtually all detectable undercutting 22 occurs during the first process of ferric chloride and ferric sulfate etching, with very little, if any, undercutting occurring during the second ferric chloride etching operation, thus the substrate is left substantially the same as it was prior to the second application of the ferric chloride. This is largely due to two things: (1) the short time (approximately 10 seconds) the etchant is allowed to remain on the blank and (2) the relative thinness (nominally ½ mil) of the aperture layer 18.

These ultimate shaped apertures 41 in the aperture layer 18 sharply define the tie bars 6 in the aperture layer 18. The tie bars in the substrate 16 are defined by the first etching operation, during which most of the etching in the substrate is caused to occur. The slot-mask manufacturing process is started by etching a preliminary aperture, smaller than desired, through the blank. The lateral etching or undercutting is designed according to a predetermined specification to yield a desired size tie bar in the substrate 16. The second etching operation is performed on a precisely specified area of the aperture layer 18 which preferably corresponds to the pattern of preliminary apertures forming apertures 41 in the aperture layer 18 with specifically designed tie bars 6 between them.

The predetermined design of the tie bars is dictated by both the preference of having narrow tie bars to reduce moire' patterns and increase mask transmission and by the desirability that the mask be structurally strong as well. As discussed in the Background of the Invention, undercutting of the aperture layer 18 is the most significant problem in maintaining narrow, yet strong, tie bars.

The process has designed within its steps controlled etching and undercutting, causing narrow, yet strong tie bars to be formed between apertures 41.

An alternative method of implementing the general principles of this invention utilizes negative-working photoresist coatings, negative masters and a preformed laminated blank. A mask blank is preformed to a biradial or generally spherical blank by any one of several methods well known in the cathode ray tube manufacturing industry. It is preferable to have a laminated mask blank 53 as shown in FIG. 18, comprising a nominal ½ mil aperture-defining (aperture) layer 51 which may be nickel or some other suitable material and an approximately 6 mil substrate layer (substrate) 49 of steel or other suitable material either bonded to the aperture-defining layer 51 or on which the aperture-defining layer 51 is plated.

Figure 18:
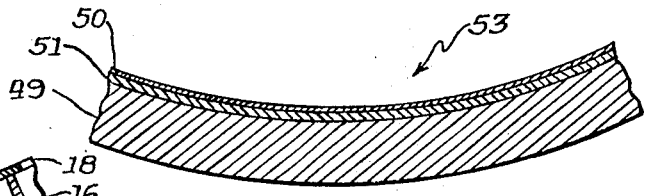
FIGS. 18–26 collectively show another process embodied in the invention.
Figure 19:
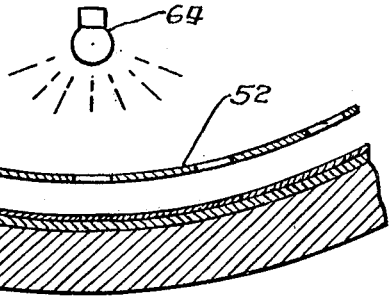
Figure 20:
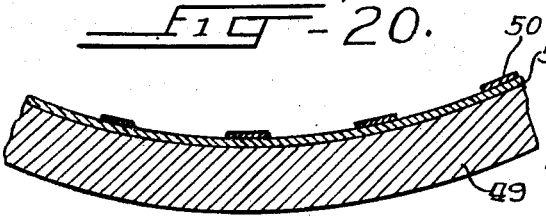

A negative photoresist coating 50 is applied to the concave aperture layer 51 of blank 53, FIG. 18. A negative master 52 having a first preselected pattern of openings through which light may be transmitted is placed with the photoresist coated blank 53 onto a lighthouse. The photoresist 50 seen through the openings in the master 52 can be exposed by a light source 64 which is actinic to the photoresist coating 50, FIG. 19, forming on the negative photoresist coating 50 an unexposed pattern of elements corresponding to those opaque image areas of the master 52 through which light was not transmitted. The nature of the negative-working photoresist 50 is such that when exposed to light, it is polymerized, leaving unpolymerized those areas of the photoresist not exposed to the light source 64.

A developing solution develops the soluble unpolymerized photoresist, baring a pattern of elements on the aperture layer 51 corresponding to those unexposed opaque image areas formed on the negative photoresist coating 50.

Figure 21:
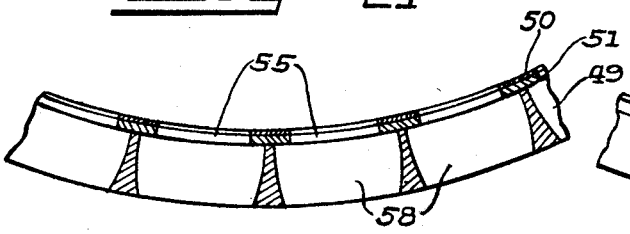
Figure 22:
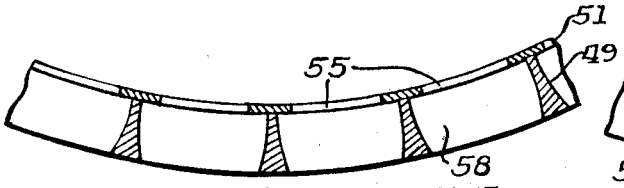
Figure 23:
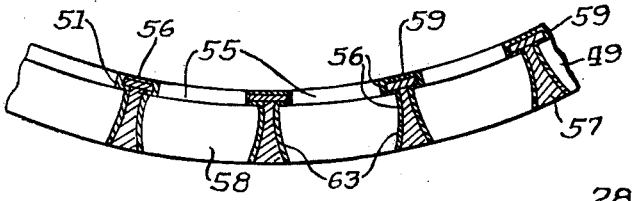
Figure 24:
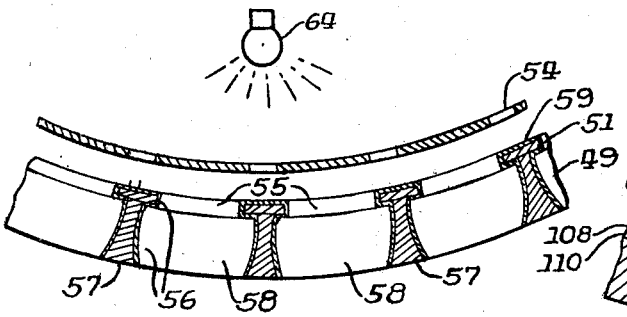
Figure 25:
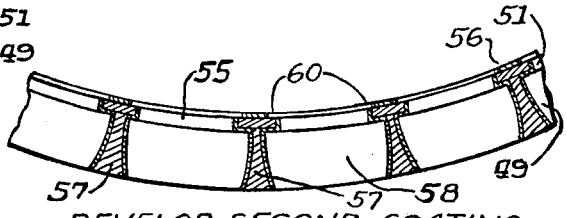
Figure 26:
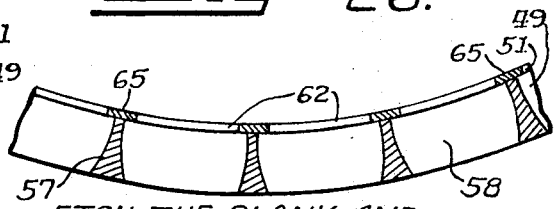

A 42 Baume concentration of ferric chloride is sprayed onto the surface of the blank 53 to etch the bared portions of the aperture layer 51 forming therein preliminary sized and shaped apertures 55 (hereafter referred to as preliminary apertures) in the aperture layer 51. The ferric chloride etchant etches through the aperture layer 51 and partially etches the substrate 49 approximately 2–3 mils. A second etchant, ferric sulfate, 45%–50% by weight, is sprayed onto the surface of the blank to etch through the partially etched substrate 49, forming in the substrate ultimate sized and shaped apertures (hereafter called ultimate apertures 58). The ferric chloride and ferric sulfate etching operations combined form one process step which is shown collectively in FIG. 21. A developing solution is then applied to the partially etched blank to wash the remaining negative photoresist 50 from the blank's aperture layer 51. The blank 53 is then washed and dried and prepared for a second negative-working photoresist coating. A second coating 56 of negative photoresist is applied to the blank's aperture layer 51 and to the walls 63 of both the preliminary apertures 55 and the ultimate apertures 58. A second negative master 54 having a second preselected pattern of openings or clear areas having substantially the same distribution as their respective counterparts in master 52, at least a predetermined group of the openings or clear areas smaller than their respective counterparts in the first master 52, is placed with the photoresist coated, partially etched blank onto a lighthouse for a second exposure process.

Light source 64 actinic to the negative photoresist exposes the photoresist coating corresponding to the second preselected pattern in the second master 54, polymerizing that photoresist exposed to the light source 64. That area of the photoresist not exposed to light will remain unpolymerized and is soluble in a suitable negative photoresist developing solution. A developer which may be the same as the developer used in the first developing process, is applied to the photoresist washing away the unpolymerized areas of the photoresist, baring a rim 60 in the aperture layer 51 around each preliminary aperture 55.

An etchant, preferably a 42 Baume concentration of ferric chloride, is used to etch the aperture layer 51 forming in the aperture layer ultimate sized and shaped apertures (hereafter called ultimate apertures 62) in the aperture layer 51. This application is approximately ten seconds in duration, long enough to merely etch the thin aperture layer 51 and short enough to cause no etching in the substrate 49. As a result of not etching the substrate 49, virtually no undercutting or lateral etching occurs in the substrate during the second ferric chloride etching process. Virtually all detectable undercutting takes place during the first etching operation where the combined ferric chloride/ferric sulfate etching processes etch the preliminary apertures 55 in the aperture layer 51 and the ultimate apertures 58 in the substrate 49.

The amount of etching done to the blank is controlled by the two step etching operation utilized in accordance with the invention. The first step comprising the ferric chloride and ferric sulfate processes etches a small preliminary aperture 55 in the aperture layer 51 and an ultimate aperture 58 in the substrate 49. By etching the smaller hole through the laminated blank the amount of overall undesirable lateral etching in the blank is substantially reduced. The second step comprising the ten second ferric chloride etchant, etches only the ultimate aperture 62 in aperture layer 51 causing no etching in the substrate, thus no lateral etching beneath the aperture layer will occur. The use of a two step etching operation maintains narrow but strong tie bars between the etched apertures.

A suitable solution is then applied to the etched blank to remove the negative photoresist that remains on the mask. After the blank is washed, it is dried and mounted in a cathode ray tube panel.

An application of the invention is to provide an etching method for recontouring or more explicitly shaping the apertures in the aperture-defining layer 18, for example so as to reduce beam clipping at the edges of the screen. As previously disclosed in reference to the preferred embodiment, the rim of photoresist 34, around the preliminary apertures 36, is substantially symmetrical about the horizontal and vertical axes of the slot, being approximately 2 mils wider on the sides of the preliminary apertures and 3 mils wider on the ends of the preliminary apertures. There are instances where it is preferable to have a non-uniform or non-symmetrical second imaging process during the second exposure step where the rim of photoresist is exposed.

For example, instead of both masks, used in the processes described above, having substantially the same distribution of openings, it may be desirable to shift the openings in the second master away from the center of the aperture formed by the first master to alter the shape of the ultimate aperture in the aperture layer. This is often desirable on the outer edges of a generally contoured blank in order to reduce beam clipping on the outer edges.

As previously explained in the manufacturing processes discussed above, the first etching process forms the preliminary apertures in the aperture layer and the ultimate apertures in the substrate. After exposing and developing the rim of photoresist around the preliminary apertures, the second etching process etches away the bared rim of metal in the aperture layer, precisely forming the desired ultimate apertures in the aperture layer. Generally, the openings or clear areas in the second master will be longer than their respective counterparts in the first master. However, this is not a strict requirement in that the second etching process forms the precise shape of the ultimate apertures in the aperture layer. Any shaped aperture may be formed in the aperture layer by a correspondingly shaped aperture in the second master and its relationship to the preliminary etched aperture.

Another aspect of the invention provides for etching a laminated, electrically conductive blank to form desired length and width tie bars in the blank. As in other processes described herein, it is desirable that the laminated blank be preformed by methods well known in the art to form mask blanks into a generally spherical or bi-radial shape and it is desirable that the aperture-defining layer (hereinafter called the aperture layer) be very thin relative to the substrate layer (hereinafter called the substrate). The method of etching the blank may be very similar to the first process described above in that the blank is first coated with a positive-working photoresist material and then exposed to a light source actinic to the photoresist. The photoresist coating is exposed through a master mask having a first preselected pattern of tie bar elements for defining the tie bar dimensions in the blank's substrate. A developer is used to develop the photoresist, polymerizing those areas exposed to light, baring areas of the aperture layer that correspond to the preliminary sized and shaped apertures, hereinafter called preliminary apertures, to be formed in the aperture layer. An etchant is sprayed onto the photoresist coated surface of the blank to etch apertures in both the aperture and substrate layers, forming between said former apertures preliminary tie bars and between the latter apertures ultimate sized and shaped tie bars.

The characteristics of etching are well known in the mask making industry, thus the end result, given a set of parameters, may be closely predicted. The reverse is also true and is the approach taken in this embodiment of the invention. The desired sized and shaped tie bars are known, thus the etching parameters may be set. In this embodiment, it is preferable that the preliminary apertures in the aperture layer be relatively small in comparison to the ultimate apertures to be formed. The substrate layer is laterally etched or undercut, while the preliminary apertures in the aperture layer are being formed, according to a predetermined amount deduced from these well known etching characteristics.

The lateral etching continues until the etchant breaks through the substrate. After the etchant breaks through, virtually all lateral etching or undercutting of the aperture layer ceases. However, it is preferable to continue etching for a short period of time to open up the aperture on the blank's convex surface forming in the process tie bars in the substrate having relatively vertical walls.

A second master having generally the same distribution of tie bar patterns as the first master is placed with the once-etched blank onto a lighthouse for a second imaging process. The second master has a second preselected pattern of tie bar elements having generally the same distribution as their respective counterparts in the first master, but at least a predetermined number of the pattern elements in the second master are smaller than their respective counterparts in the first master. The second exposure process through the second master exposes a rim of photoresist around each preliminary aperture in the aperture layer. The subsequent developing of the newly exposed photoresist bares the aperture layer in those areas corresponding to the exposed rim of photoresist, and in so doing defines the precise width and length tie bar in the aperture layer. An etchant etches away the newly bared rim in the aperture layer, forming the precise width and length tie bar. The etched blank is subjected to a wash for removing any remaining photoresist from the surface of the etched mask and dried prior to being mounted in a cathode ray tube faceplate.

Figure 27:
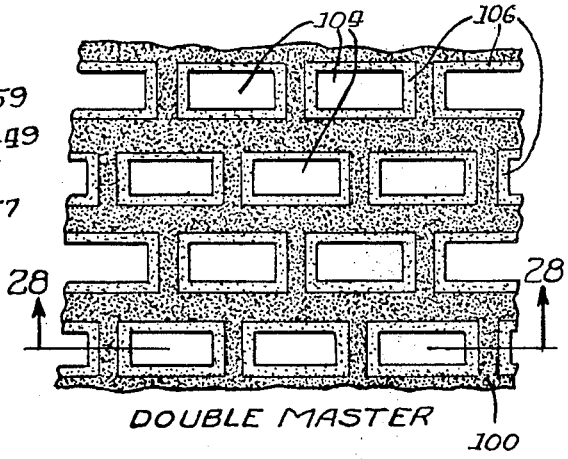
FIG. 27 shows a top view of a slot-type shadow mask used in a process embodied in the invention

Yet another method of forming apertures in a color selection mask blank which accords with the teachings herein is an improvement described and claimed specifically in the referent copending application Ser. No. (2176). This method is a single exposure method utilizing the etchant application as described in the preferred embodiment first described above. Again an electrically conductive laminated blank 101, FIG. 28, comprising preferably a nominal ½ mil nickel aperture-defining layer 110 and approximately 6 mils of steel as a substrate 112 is preformed into a generally spherical, bi-radial or multi-contoured shaped blank having the general curvature characteristics of a cathode ray tube faceplate. The blank is coated with a positive photoresist material 108 on the aperture-defining layer as previously described. The blank along with a novel, specially constructed master 100 (FIG. 27) is placed on a lighthouse and through the preselected pattern of elements in the master a light source 102 actinic to the photoresist coating 108 exposes a corresponding pattern of elements on the photoresist coating.

The master used in this process has two patterns of openings through which light may be transmitted. See FIG. 27. Each of these patterns, when placed with the photoresist coated blank on a lighthouse and exposed by light source 102, forms a distinct pattern on the photoresist coating. The pattern of openings in the master are superimposed over each other. It is preferable that the first pattern of openings, a preliminary pattern, be transparent and of a predetermined size and shape. They may be sharply rectangular in shape but they are not limited to such a shape. The second pattern of openings is superimposed over the first pattern and at least a predetermined group of the openings are larger than their respective counterparts in the first pattern. When superimposed, the two patterns of openings look like the master displayed in FIG. 27. The clear areas 104 correspond to the openings in the first pattern and the shaded 106 and clear 104 areas collectively correspond to the openings in the second pattern.

A first pattern of elements on the photoresist is created when light source 102 shines through the master's clear areas 104 onto the photoresist coating. Contemporaneously, a second pattern of elements is created on the photoresist coating when light source 102 shines through the shaded 106 and clear 104 areas, collectively.

Figure 28:
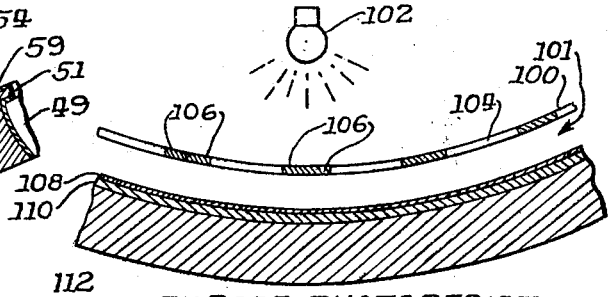
FIG. 28 shows a cross-sectional view of the mask in FIG. 27 being used in a process embodied in the invention.
Figure 29:
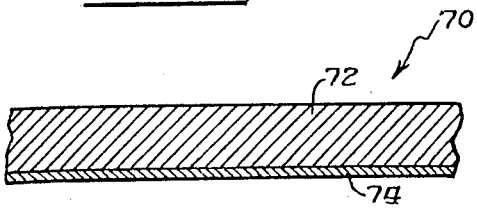
FIGS. 29–36 collectively show the inventive process being utilized in a conventional shadow mask manufacturing process.

The neutral density of the shaded area being substantially different than that of the clear areas makes the degree of exposure of the two patterns on the photoresist decidedly different, FIG. 28, the areas corresponding to the shaded areas 106 in master 100 being less exposed than those areas corresponding to the master's clear areas 104.

A developer solution, which is preferably a caustic base solution, having a predetermined concentration is applied to the blank for a first predetermined amount of time, washing away the photoresist exposed through the clear areas of the mask.

An etchant, which may be the same as those etchants used in the other processes described herein, is sprayed onto the blank surface etching preliminary sized and shaped apertures in the aperture layer and ultimate sized and shaped apertures in the substrate.

A developer solution, having a second predetermined concentration which may be the same as that developer used to develop the photoresist the first time, is applied to the blank surface for a second predetermined amount of time washing away that photoresist exposed through the shaded area 109 of master 100 at the same time cleaning the apertures of any photoresist residue which tends to accumulate in the apertures of the etching process. As is well known in the photographic art, a less exposed photographic material developed for a longer period of time can be comparable to a more exposed photographic material developed for a shorter period of time. Thus the respective degrees of exposure, the time for developing the two differently exposed areas of the photoresist and the concentration of the developer can cause essentially the same result as in the other process described herein, that is, a rim of the aperture layer is bared.

Again an etchant, preferably ferric chloride, is sprayed onto the blank surface, etching the bared rim of the aperture layer that surrounds each preliminary aperture, forming in the aperture layer ultimate sized and shaped apertures.

A caustic base solution may then be used to remove any remaining photoresist in final preparation of readying the completed mask for mounting in a cathode ray tube panel.

A different approach still encompassed by the principles of the invention, is the utilization of two separate masters instead of the one composite master 100 (see FIG. 27) used in the method just described. This method utilizes two separate masters, one master having a first predetermined pattern of clear openings, the second master having a second predetermined pattern of clear openings, the remainder of the mask having a predetermined neutral density but not being opaque. The distribution of openings in the two masks is substantially the same, but at least a predetermined number of the openings in the second master may be smaller than their respective counterparts in the first master. Superimpose the two masks and expose a photoresist covered blank to a light source actinic to the photoresist. The exposure pattern on the photoresist may be substantially the same as that pattern in the most recently disclosed process (see FIG. 28). The etching steps may be similarly performed to etch first preliminary apertures in the aperture layer and ultimate apertures in the substrate and then the ultimate apertures in the aperture layer.

The principles of this invention have application other than as described above, for example, in the manufacture of negative guardband cathode ray tube mask-screen assemblies. As suggested above in the Background of the Invention in the manufacture of negative guardband type tubes, the shadow mask must be caused to have apertures whose size is larger than the respective associated phosphor elements. The flow diagram illustrated in FIGS. 29–36 depict a method for making negative guardband mask-screen assemblies of the so-called dot-mask, dot-screen type which implements the principles of this invention.

The first step (FIG. 29) in the FIGS. 29–36 method is the provision of a mask blank 70, preferably having a substrate 72 on which is disposed a relatively thin aperture-defining layer 74. As in the above-described embodiments, the substrate 72 may be composed of steel and the aperture-defining layer 74 may be a thin coating or bonded layer of nickel or other suitable material.

Figure 30:
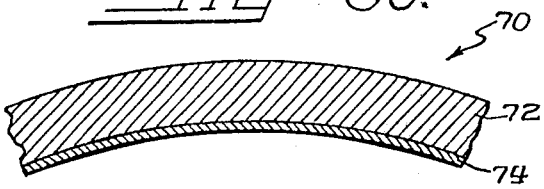

As shown schematically in FIG. 30, the blank 70 is next formed to the desired three-dimensional contour, typically a spherical or compound radial contour corresponding generally to the curvature of the associated cathode ray tube faceplate. The blank may be formed by any of the well-known mask blank forming processes.

Figure 31:
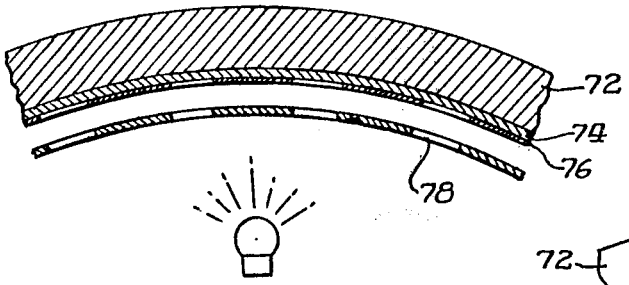
Figure 32:
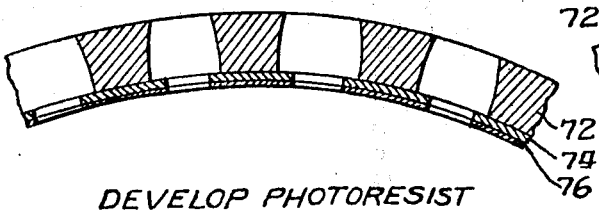

As shown in FIG. 31 the formed blank 70 is then covered on its concave side with a photosensitive etchant-resistant structure such as a positive-working photoresist coating 76. The coating 76 is exposed to a first preselected illumination pattern, as formed for example through a first master 78. The master 78 has a first preselected pattern of light-transmissive openings corresponding in distribution to the pattern of electron-transmissive apertures to be formed in the blank 70, at least a predetermined group of the pattern of openings being caused to have a smaller size than the ultimate desired mask aperture size. The reason for causing the openings to be smaller than the desired ultimate mask aperture size will become evident as this description proceeds. The exposed photoresist coating 76 is then developed and the blank 70 etched through, as shown schematically in FIG. 32. The development and etching operations may follow the above teachings.

It should be noted that the method under discussion is useful in the manufacture of color cathode ray tubes according to the conventional approach in which the masks and screen faceplates are mated or paired throughout the tube manufacturing operations, rather than with respect to a process as discussed above wherein masks are interchangeable each with all others and screened faceplates are interchangeable each with all others. In conventional practice of cathode ray tube manufacture the shadow mask is used as a photographic stencil in the photoscreening of the screens. By this expedient any irregularities in the mask aperture pattern are replicated identically in the patterns of phosphor elements, thus insuring registrability between paired masks and screens.

Figure 33:
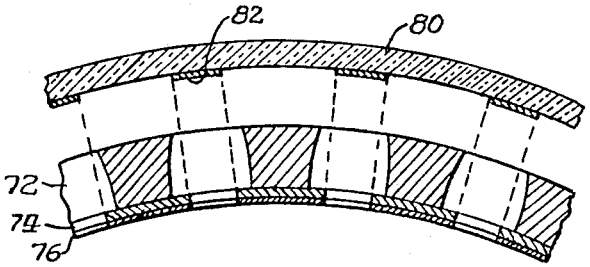

Returning now to a discussion of the FIGS. 29–36 method — as shown in FIG. 33, the formed and etched blank 70 is used as a photographic stencil in the photoscreening of a black surround on faceplate 80. To digress for a moment, the method of depositing a black grille or black surround is preferably that taught, for example, in U.S. Pat. No. 3,632,339 to Khan. According to that method, a negative photoresist is exposed through a master (in this case the etched mask blank 70) and developed, leaving a pattern of photoresist elements on the faceplate (here shown as elements 82). The elements are overcoated with a layer of light-absorptive material such as graphite and then chemically stripped from the faceplate along with the overlying light-absorptive material. The result is a black surround pattern having openings into which phosphor material is subsequently deposited. The size, shape and distribution of the openings in the black surround pattern determine the size, shape and distribution of the phosphor elements.

Returning to FIG. 33, after use of the mask blank 70 as a photograpic stencil in the photoscreening of the faceplate 80, the blank 70 is again placed in a lighthouse and the photoresist coating 76 exposed a second time. See FIG. 34. The operations disclosed in FIG. 34 and the following FIG. 35 (to be described below) may be thought of in the broad sense as collectively constituting a step wherein a second etchant-resistant structure is formed on the aperture-defining layer 74. More narrowly, and in the context of the method embodiment being described, the steps represented by FIGS. 34 and 35 may be considered as operations on the photoresist layer 76 which change the etchant masking properties thereof.

Figure 34:
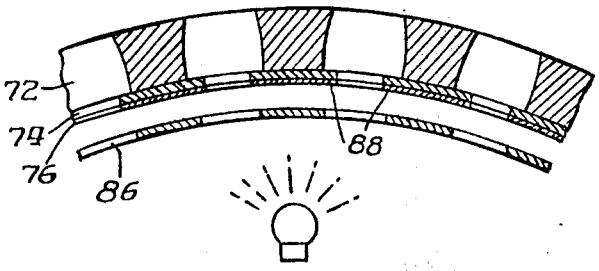
Figure 35:
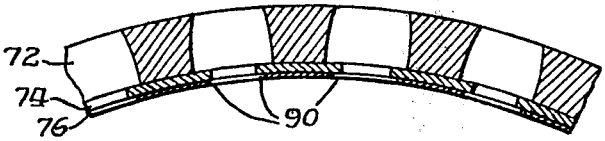

Specifically considering FIG. 34 — the photoresist coating 76 is exposed to light actinic thereto through a second master 86 which has openings distributed as the openings in master 78 but at least a group thereof (corresponding to the said group of openings in the first master 78) being larger than in the first master 78. The effect of using a master having enlarged apertures is that a rim 88 in the photoresist coating 76 surrounding the preliminary apertures 84 in the aperture-defining layer 74 is exposed and depolymerized.

The depolymerized areas are then removed by a development operation (FIG. 35) baring a rim 90 around each of the preliminary apertures 84 in the aperture-defining layer 74.

Figure 36:
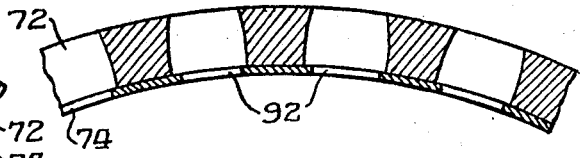

The blank is etched again in a brief etching operation, which may be as discussed above in connection with the first described embodiment, to remove the rims 90. The end-product mask is thus formed as shown in FIG. 36 and has apertures 92 which are of the desired ultimate size and shape. By proper selection of the parameters of the first and second masters and of the developing and etching operations, the size of the ultimate apertures 92 is caused to be greater than the size of the phosphor elements 82 by an amount equal to the allotted (negative) purity tolerance value.

A further alternative embodiment of the invention utilizes a preformed laminated mask blank 120, FIG. 37, which may be preformed according to any well-known mask forming method used in the present mask manufacturing processes as conceptually shown and discussed in the first process described above. The preformed blank 120 is first coated on its concave surface with a negative-working photoresist 122, for example, a Norland sensitized photoresist. A negative master 124, FIG. 38, having a first predetermined pattern of openings through which light may be transmitted and the negative-working photoresist-coated blank are placed on a lighthouse and upon exposure to a light source 126 actinic to the negative photoresist, a pattern of ultimate sized and shaped apertures, corresponding to the pattern of openings in the negative master 124, is formed on the negative photoresist layer 122. These areas of the negative photoresist layer exposed to the light source 126 become polymerized. A developer solution, FIG. 39, may be applied to the photoresist layer, washing away the non-polymerized area of the photoresist, that is, those areas not subjected to the light, leaving a pattern of apertures 128 on the photoresist layer having the ultimate size and shape, hereafter called ultimate apertures.

The negative-working photoresist-coated, exposed and developed blank 120 is then coated with a positive-working photoresist 130, for example Shipley's AZ 1350 positive-working photoresist. See FIG. 40. A positive master 132, FIG. 41, having a distribution of openings substantially similar to the pattern of openings in the negative master 124, FIG. 38, and the twice photoresist-coated blank 120 are placed on a lighthouse and on exposure to light, which may be the same as light source 126, actinic to the positive photoresist, a second preselected pattern of apertures are formed on the positive photoresist layer 130, FIG. 42, at least a predetermined number of the apertures being substantially smaller than their respective counterparts formed on the negative photoresist layer 122 during the previous exposing and developing operation.

Usually, a negative photoresist material is more sensitive and may be exposed more quickly than a positive photoresist material, however, with a negative photoresist buffer between the aperture-defining layer and the positive photoresist layer, a substantially thinner layer of positive photoresist may be coated on top of the negative photoresist layer than in other positive photoresist methods heretofore discussed.

Being substantially thinner than a typical positive photoresist coating coated directly onto a metal electrode blank, a shorter exposure time may be used in exposing the positive photoresist layer 130. On exposure, the exposed areas of photoresist are depolymerized by the actinic light source. A developer solution, see FIG. 42, preferably a caustic base solution, washes away the depolymerized area of the positive photoresist, forming in the positive photoresist layer 130 a pattern of apertures having a preliminary sized and shaped aperture, hereinafter called preliminary apertures 134.

On the concave surface of the electrode blank 120, FIG. 42, is an etchant-resistant structure comprising a coating of polymerized negative photoresist 122 having a pattern of ultimate apertures 128 therein. Covering the negative photoresist 122 and the pattern of ultimate apertures 128 is a coating of positive non-depolymerized photoresist 130 having a pattern of preliminary apertures 134 corresponding in distribution to the pattern of ultimate apertures 128 in the negative photoresist layer 122, FIG. 39. However, a predetermined number of these preliminary apertures 134 are substantially smaller than the ultimate apertures 128 formed in the negative photoresist layer. An etchant which may be ferric chloride, FIG. 43, is applied to the electrode blank 120, etching the aperture-defining layer 136 and the substrate layer 138 according to the preliminary apertures 134 formed in the positive photoresist layer 130. The apertures formed in the aperture layer 136 will be the preliminary apertures 134 and the apertures formed in the substrate 138 will be ultimate sized and shaped apertures 140.

Two etchants, preferably ferric chloride and ferric sulfate, as described in the first process above, may be used to etch through the aperture 136 and the substrate 138 layers. The etchants, preferably ferric chloride and ferric sulfate, etch through the aperture and substrate layers. A concentrated solution of developer is used to flood the blank's surface to strip the photoresist 130, leaving the layer of polymerized negative photoresist 122 and the pattern of apertures in the negative photoresist layer. Each preliminary etched aperture 134 is surrounded by narrow rim 142 of the aperture-defining layer. Again an etchant, preferably ferric chloride, is applied to the electrode blank surface, etching the rim 142 of the aperture layer surrounding the preliminary apertures, forming the ultimate apertures 128 in the aperture-defining layer 136. See FIG. 45.

A caustic base solution may then be applied to the blank surface, FIG. 46, stripping the remaining polymerized negative photoresist from the blank surface. The finished mask is then prepared for mounting in a cathode ray tube faceplate.

Still other changes may be made in the above-described methods without departing from the true spirit and scope of the invention herein involved and it is intended that the subject matter in the above depiction shall be interpreted as illustrative and not in a limiting sense.

What is claimed is:

1. For use in the manufacture of color selection masks for color television cathode ray tubes, a method of forming a pattern of electron-transmissive apertures of a predetermined size, shape and distribution in a color selection mask, said method comprising:

providing an etchable, electrically conductive blank having a substrate on which is disposed a relatively thin aperture-defining layer;

applying a photosensitive etchant-resistant structure on said aperture-defining layer of said blank and forming therein by photoexposure and development operations a first preselected pattern of openings corresponding in distribution to the pattern of electron-transmissive apertures to be formed, at least a predetermined group of openings in said pattern of openings being caused to have a smaller size than the desired ultimate mask aperture size;

etching through the blank to form in said aperture-defining layer a preliminary pattern of apertures having, at least in a group of apertures corresponding to said group of openings, a predetermined size which is smaller than a desired ultimate mask aperture size and to form in the substrate a pattern of apertures respectively undercutting the apertures in said aperture-defining layer;

chemically enlarging said group of openings in said etchant-resistant structure on said aperture-defining layer to substantially said ultimate mask aperture size; and etching through the newly bared portions of said aperture-defining layer resulting from enlarging said groups of openings in said etchant-resistant structure to form a pattern of electron-transmissive apertures in the aperture-defining layer of the blank having the desired ultimate mask aperture size and shape.

2. A method as defined in claim 1 wherein said aperture-defining layer is thinner than said substrate.

3. The method defined by claim 1 wherein said etchant-resistant structure constitutes a common singular layer of positive-working photoresist material which is exposed to actinic radiation and developed a first time to form said first preselected pattern of openings, and which is subsequently chemically enlarged by exposing the layer to actinic radiation and developing said structure a second time to enlarge at least said group of openings.

4. For use in the manufacture of color selection masks for color television cathode ray tubes, a method of forming a pattern of electron-transmissive apertures of a predetermined size, shape and distribution in a color selection mask, said method comprising:

providing an etchable, electrically conductive blank having a substrate on which is disposed an aperture-defining layer;

establishing a first etchant-resistant structure on said aperture-defining layer of said blank which has formed therein a first preselected pattern of openings corresponding in distribution to the pattern of electron-transmissive apertures to be formed, but at least a predetermined group of said openings having a smaller size than the desired ultimate mask aperture size;

etching through the blank to form in said aperture-defining layer a preliminary pattern of apertures having, at least in a group of apertures corresponding to said group of openings, a predetermined size which is smaller than a desired ultimate mask aperture size and to form in the substrate a pattern of apertures respectively undercutting the apertures in said aperture-defining layer;

establishing a second etchant-resistant structure on said aperture-defining layer which has formed therein a second preselected pattern of openings in which the openings substantially correspond in distribution to the pattern of openings in said first etchant-resistant structure, but at least a predetermined group of which, corresponding to said group of openings in said first structure, substantially corresponds in size to said ultimate mask aperture size; and etching through the newly bared portions of said aperture-defining layer resulting from the enlargment of said group of openings in said etchant-resistant structure to form a pattern of electron-transmissive apertures in the aperture-defining layer of the blank having the desired ultimate mask aperture size and shape.

5. A method as defined in claim 4 wherein said aperture-defining layer is thinner than said substrate.

6. The method defined by claim 4 including the step of preforming the blank into a three-dimensionally curved configuration with the aperture-defining layer on the concave side before applying the first etchant-resistant structure.

7. The method defined by claim 4 wherein said first and second etchant-resistant structures constitute a common singular layer of positive photoresist material which is exposed to actinic radiation and developed a first time to form said first preselected pattern of openings, and which is subsequently chemically enlarged by exposing the layer to actinic radiation and developing said structure a second time to form said second preselected pattern of openings.

8. The method defined by claim 7 wherein said color selection mask is a slot-type mask having slots separated by tie bars and wherein the second etching step is effective only to narrow the tie bars formed in said aperture-defining layer.

9. For use in the manufacture of color selection masks for color television cathode ray tubes, a method of forming a pattern of electron-transmissive apertures of a predetermined size, shape and distribution in a color selection mask, said method comprising:

providing an etchable, electrically conductive blank having a substrate layer on which is disposed an aperture-defining layer;

applying a coating of photoresist material on said aperture-defining layer of said blank;

exposing the photoresist coating in a first preselected illumination pattern with pattern elements corresponding in distribution to the pattern of electron-transmissive apertures to be formed, at least a predetermined group of said pattern of elements being caused to have a smaller size than the desired ultimate mask aperture size;

developing the exposed photoresist;

etching through the blank to form in said aperture-defining layer a preliminary pattern of apertures having, at least in a group of apertures corresponding to said group of pattern elements, a predetermined size which is smaller than a desired ultimate mask aperture size and to form in the substrate layer a pattern of apertures respectively undercutting the apertures in said aperture-defining layer;

exposing the photoresist coating on said aperture-defining layer in a second preselected illumination pattern in which the pattern elements substantially correspond in distribution to the pattern elements of said first illumination pattern, but at least the elements in a predetermined group of which elements substantially correspond in size to said ultimate mask aperture size;

developing the newly exposed areas of the photoresist coating; and etching through the newly bared portions of said aperture-defining layer resulting from the second exposure and development of the photoresist coating to form a pattern of electron-transmissive apertures in the aperture-defining layer of the blank having the desired ultimate mask aperture size and shape.

10. A method as defined in claim 9 wherein said aperture-defining layer is thinner than said substrate layer.

11. A method as defined in claim 9 wherein said photoresist coating is a positive-working photoresist coating.

12. A method of forming a pattern of electron-transmissive apertures in said color selection mask in accordance with claim 10 wherein said first etching of the exposed photo-resist yields both a predetermined (preliminary) unetched area between said apertures on said aperture-defining layer and a desired ultimate unetched area between said apertures in said substrate layer, and wherein said second exposure and subsequent etching of said aperture-defining layer yields a desired smaller ultimate unetched area between said apertures on said aperture-defining layer.

13. An aperture-forming method in accordance with claim 12 wherein said unetched areas are the tie bars and vertical slats between said apertures of a slot-type color selection mask.

14. An aperture-forming method in accordance with claim 13 wherein said desired ultimate unetched area between said apertures on said aperture-defining layer is smaller than said preliminary predetermined unetched area only in the tie bar areas.

15. An aperture-forming method in accordance with claim 14 wherein said aperture-defining layer has a thickness of about ½ mil and is composed of nickel, and wherein said substrate layer has a thickness of about 6 mil and is composed of steel.

16. An aperture-forming method according to claim 10 wherein said color selection mask is preformed into a three-dimensionally curved configuration prior to application of the photoresist coating.

17. An aperture-forming method in accordance with claim 16 wherein said preformed mask is formed from a flat blank to assume a generally spherical or multiradial contour.

18. An aperture-forming method in accordance with claim 17 wherein said aperture-defining layer is on the concave side of the mask, is about ½ mil in thickness and is composed of nickel, and wherein said substrate layer is about 6 mil in thickness and is composed of steel.

19. An aperture-forming method in accordance with claim 18 wherein said forming of said apertures is accomplished by etching from the concave side of said contoured preformed color selection mask.

20. An aperture-forming method according to claim 9 wherein said method of forming a pattern of electron-transmissive apertures includes a method of precisely shaping each and all of said apertures into a desired ultimate shape.

21. A method of shaping electron-transmissive apertures in accordance with claim 20 wherein prior to the application of the photoresist coating, the color selection mask blank is preformed from a flat blank according to the generally three-dimensional contour of said cathode ray tube's panel.

22. For use in the manufacture of a slot-type color selection mask for a color television cathode ray tube, a method of developing narrow tie bars between the electron-transmissive apertures in said mask, comprising the steps of:

providing an etchable, electrically conductive blank comprising a substrate and an aperture-defining layer thereon;

applying a coating of positive-working photoresist to said aperture-defining layer of said blank;

exposing said photoresist coating in a first preselected illumination pattern to produce between said exposed pattern elements a preliminary unexposed pattern;

developing the exposed photoresist coating to leave the preliminary unexposed patterns, said unexposed patterns including preliminary tie bars and slats between the apertures;

etching through the blank to form a pattern of preliminary sized and shaped apertures, leaving between said apertures in the aperture-defining layer a preliminary sized and shaped pattern of tie bars and in the substrate an ultimate sized and shaped tie bar between each respective aperture;

exposing a preselected portion of the photoresist coating on the aperture-defining layer corresponding to a preselected portion of the unetched tie bars in the aperture-defining layer, leaving an unexposed area between said exposed and etched patterns corresponding to ultimate sized and shaped tie bars in the aperture-defining layer;

developing the newly exposed photoresist coating thus baring the aperture-defining layer; and etching the newly bared aperture-defining layer leaving on said layer and between said etched apertures tie bars having an ultimate size and shape.

23. A method of forming narrow tie bars in accordance with claim 22 wherein said aperture-defining layer is thinner than said substrate layer and the overall electrode thickness.

24. A method of forming tie bars in accordance with claim 22 wherein said aperture-defining layer is comprised of ½ mil thick nickel layer and said substrate layer is comprised of 6 mils of steel.

25. A method of forming narrow tie bars in accordance with claim 24 wherein said color selection blank is preformed to a generally three-dimensional contour prior to the tie bar etching process.

26. A method of forming narrow tie bars in accordance with claim 24 wherein said aperture-defining layer is on the concave surface of said generally three-dimensional preformed blank and said etching is from the concave side of said blank.

27. A method of forming tie bars in accordance with claim 26 wherein said first etching maintains on said aperture-defining layer a preliminary unetched tie bar surface between said etched apertures and maintains on the substrate layer a tie bar having a substantially fixed width between said etched apertures, and wherein said second etching maintains on each respective aperture-defining layer a tie bar having an ultimate desired width between the etched apertures.

28. A method of forming tie bars in accordance with claim 27 wherein said first etching etches through said aperture-defining layer and through approximately ½ of said substrate layer, and said second etching etches through said aperture-defining layer forming desired width tie bars between the etched apertures.

* * * * *